US011234480B2

(12) United States Patent
Thomasson

(10) Patent No.: US 11,234,480 B2
(45) Date of Patent: Feb. 1, 2022

(54) MODULAR SHOE

(71) Applicant: Gaynor Marie Thomasson, Monton Greater Manchester (GB)

(72) Inventor: Gaynor Marie Thomasson, Monton Greater Manchester (GB)

( * ) Notice: Subject to any disclaimer, the term of this patent is extended or adjusted under 35 U.S.C. 154(b) by 348 days.

(21) Appl. No.: 15/319,530

(22) PCT Filed: Jul. 3, 2015

(86) PCT No.: PCT/IB2015/055044
§ 371 (c)(1),
(2) Date: Dec. 16, 2016

(87) PCT Pub. No.: WO2016/001900
PCT Pub. Date: Jan. 7, 2016

(65) Prior Publication Data

US 2017/0318895 A1 Nov. 9, 2017

(30) Foreign Application Priority Data

Jul. 3, 2014 (GB) ..... 1411866

(51) Int. Cl.

| | |
|---|---|
| ***A43B 3/24*** | (2006.01) |
| ***A43B 3/12*** | (2006.01) |
| ***A43B 23/02*** | (2006.01) |
| ***A43C 11/14*** | (2006.01) |
| *A43C 1/00* | (2006.01) |

(52) U.S. Cl.
CPC ..... *A43B 3/24* (2013.01); *A43B 3/122* (2013.01); *A43B 3/244* (2013.01); *A43B 23/0245* (2013.01); *A43C 11/1493* (2013.01); *A43C 1/00* (2013.01)

(58) Field of Classification Search
CPC ..... A43B 3/24; A43B 3/244; A43B 3/246
See application file for complete search history.

(56) References Cited

U.S. PATENT DOCUMENTS 2,761,224 A * 9/1956 Gardiner ..... A43B 3/122 36/101
3,204,346 A * 9/1965 Lockard ..... A43B 3/24 36/101

(Continued)

FOREIGN PATENT DOCUMENTS

| | | |
|---|---|---|
| EP | 1 588 639 | 10/2005 |
| FR | 2 961 380 | 12/2011 |

(Continued)

OTHER PUBLICATIONS

International Search Report (ISR) dated Jan. 7, 2016 in International (PCT) Application No. PCT/IB2015/055044.

(Continued)

*Primary Examiner* — Megan E Lynch
(74) *Attorney, Agent, or Firm* — Wlliam H. Bollman

(57) ABSTRACT

The present invention provides a modular shoe adapted to be configured by a wearer comprises: a sole capable of receiving a shoe upper for arrangement over a wearer's foot by at least one channel. In this way the wearer is able to configure multiple shoe arrangements by use of modular parts that are interchangeable to create customised shoes that are lighter and can be packed away smaller than traditional shoes.

16 Claims, 15 Drawing Sheets

(56) References Cited

U.S. PATENT DOCUMENTS

| | | | | | |
|---|---|---|---|---|---|
| 4,193,214 | A * | 3/1980 | Wang | A43B 3/122 | 36/100 |
| 4,317,294 | A * | 3/1982 | Goodyear | A43B 13/36 | 36/100 |
| 4,377,042 | A * | 3/1983 | Bauer | A43B 13/36 | 36/101 |
| 4,887,369 | A * | 12/1989 | Bailey | A43B 3/24 | 36/101 |
| 5,065,531 | A | 11/1991 | Prestridge | | |
| 5,337,491 | A * | 8/1994 | Mascotte | A43B 3/16 | 36/7.1 R |
| 5,992,058 | A | 11/1999 | Jneid | | |
| 7,272,899 | B1 | 9/2007 | Marak | | |
| 7,578,075 | B1 | 8/2009 | Kemp | | |
| 7,698,834 | B1 * | 4/2010 | Courville | A43B 3/24 | 36/100 |
| 8,020,319 | B1 | 9/2011 | Mohaupt | | |
| 8,250,780 | B1 * | 8/2012 | Diaz | A43B 3/122 | 36/101 |
| 2002/0174569 | A1 * | 11/2002 | Tsai | A43B 3/103 | 36/101 |
| 2005/0016019 | A1 * | 1/2005 | Smith | A43B 3/103 | 36/11.5 |
| 2005/0097781 | A1 * | 5/2005 | Greene | A43B 3/122 | 36/101 |
| 2005/0235522 | A1 | 10/2005 | Crowley, II et al. | | |
| 2006/0059720 | A1 | 3/2006 | Phelan | | |
| 2006/0112597 | A1 * | 6/2006 | Stern | A43B 3/103 | 36/101 |
| 2008/0098623 | A1 * | 5/2008 | Komitau | A43B 3/24 | 36/101 |
| 2009/0293312 | A1 | 12/2009 | Scozzafava | | |
| 2010/0024251 | A1 * | 2/2010 | Delgatty | A43B 1/0027 | 36/101 |
| 2012/0216429 | A1 * | 8/2012 | Bastida | A43B 3/122 | 36/25 R |
| 2013/0091732 | A1 * | 4/2013 | Mendoza | A43B 3/0078 | 36/100 |
| 2013/0219751 | A1 * | 8/2013 | Catlett | A43B 3/122 | 36/101 |
| 2014/0165426 | A1 | 6/2014 | Chapin | | |
| 2014/0196307 | A1 * | 7/2014 | Fremming | A43B 1/0027 | 36/15 |
| 2015/0020414 | A1 * | 1/2015 | Mulholland | A43B 1/0081 | 36/100 |

FOREIGN PATENT DOCUMENTS

| | | | |
|---|---|---|---|
| FR | 2 973 655 | 10/2012 | |
| GB | 2463265 | 3/2010 | |
| WO | 2008/050346 | 5/2008 | |
| WO | WO-2014198257 A1 * | 12/2014 | A43B 3/244 |
| WO | 2016/023078 | 2/2016 | |

OTHER PUBLICATIONS

Examination Report under Section 18(3) dated Nov. 1, 2016 in Application No. GB 1608562.3.

Combined Search and Examination Report under Sections 17 and 18(3) issued Jan. 9, 2015 in Application No. GB1411866.5.

* cited by examiner

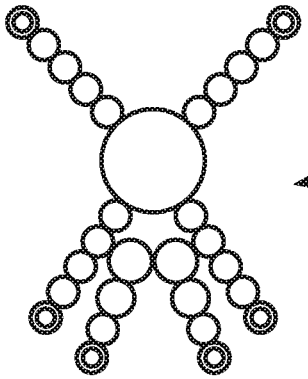
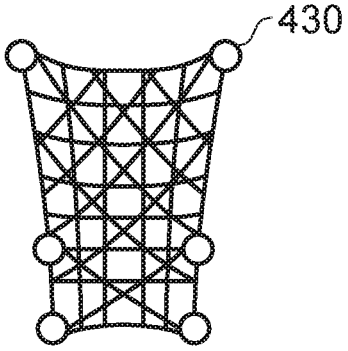
400
FIG. 5A
FIG. 5B
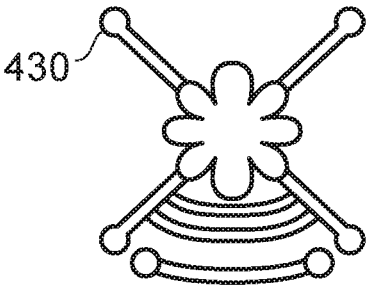
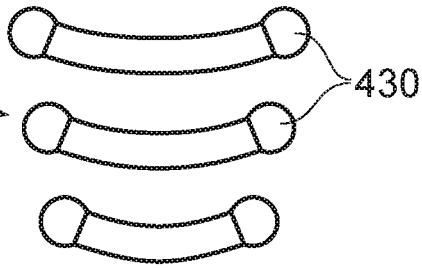
400
FIG. 5C
FIG. 5D
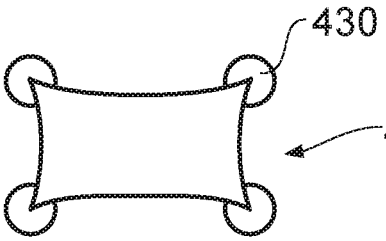
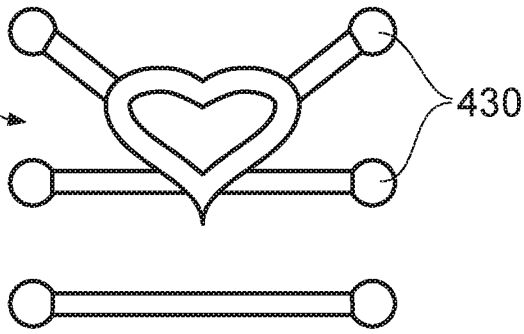
400
FIG. 5E
FIG. 5F

MODULAR SHOE

FIELD OF INVENTION

The present invention describes a modular shoe, in particular but not exclusively a modular shoe with interchangeable parts so that shoe type and appearance can be altered.

BACKGROUND

Shoes are available in a variety of sizes and styles. Typically a wearer chooses and purchases the shoe they want for a particular purpose and often in a particular style that corresponds to an activity or to clothing with which they will be worn. Therefore people traditionally have many different pairs of shoes in order to suit different outfits and activities.

A person is often required to purchase and store may different shoes which can be problematic. Furthermore the shoes may ware over time and although some shoes can be repaired, for example being re-heeled, this is not possible with all shoes.

In particular with ladies footwear types of shoe vary with changes in fashion and as a result there is a constant desire to purchase new shoes. This can be costly and can require considerable amounts of storage space.

Also when travelling various different types and style of shoe may be required, for example for work, relaxation and for an event such as a wedding.

Therefore several different shoes must be packed which can take up a lot of space. This may mean a person is limited in the number of pairs of shoes they can take away with them.

The present invention arose in order to overcome the aforementioned problems and provides a shoe which is versatile and may be easily transported.

PRIOR ART

Standard shoes serve to support and protect a wearer's feet. A standard shoe, such as a court shoe, training shoe or sandal comprises a sole with a permanently fitted shoe upper and optionally a heel so that the shoe is a single unit. Standard shoes are provided in fixed styles and the wearer will purchase shoes in a desired style, for example for a particular purpose, and in the desired size so as to fit the wearer's feet. French Patent Application FR2961380 (Olivier) discloses a device for realising multiple models of sandals from a single base with elastic straps.

French Patent Application FR2973655 (Bedoui) discloses a kit for assembling a pair of sandals with a sole comprising a set of loops on an upper side to permit passage of strands of straps.

U.S. Pat. No. 5,992,058 (Jneid) discloses a detachable shoe strap system for providing an assortment of easily interchangeable systems of footwear in a single system using fasteners arranged about the sole.

U.S. Pat. No. 7,272,899 (Marak) discloses shoes that are made to allow straps to be attached, removed, covered or exchanged so that different looks can be achieved having a base with a plurality of strap attachment loops.

U.S. Pat. No. 7,578,075 (Kemp) discloses a collapsible shoe with a sole having a heel mounting, a removable heel, removable platform and one or more removable strap, wherein the sole includes a heel attachment mechanism.

U.S. Pat. No. 8,020,319 (Mohaupt) discloses an interchangeable shoe strap system with a sole member having an elastic binding with a series of knots and mounting studs.

U.S. Pat. No. 8,250,780 (Diaz) discloses a sandal system kit comprising a base wherein a slot is disposed in the base at a front edge and a track is disposed along edges to accept S-clips.

U.S. 2006/0059720 (Phelan) discloses an article of footwear comprising a sole and a perimeter edge with a plurality of loops and an upper portion to enwrap a foot.

U.S. 2009/0293312 (Scozzafava) discloses an article of footwear comprising a shoe base and an ankle section with at least two loops fixedly attached to the toe section.

U.S. 2014/0165426 (Chapin) discloses a convertible shoe having a sole and plurality of receiving means that may be permanently or removably affixed to the sole.

The present invention provides a means of attaching a shoe upper at any location about the perimeter edge of the shoe so that the shoe upper is arranged to perfectly fit a wearer's foot wherein the once located in the desired location the shoe upper can be locked in place.

SUMMARY OF INVENTION

According to a first aspect of the present invention there is provided a modular shoe adapted to be configured into at least two different forms comprises: a sole which receives a shoe upper for arrangement over a wearer's foot, the sole having a channel around its outer perimeter/surface for receiving and engaging with the shoe upper, wherein the shoe upper has at least one connection portion adapted to be received by the channel so as to permit movement of the connection portion and thereby the shoe upper with respect to the sole, along the channel, to a desired configuration and a locking means to lock the connection portion at a fixed position with respect to the channel.

In this way multiple forms of shoes can be created from use of one sole. Advantageously as the channel is continuous about the perimeter of the sole the location of any shoe uppers can be adjusted to the particular dimensions of the wearer's feet. For example enabling feet of different shapes and sizes to be readily accommodated for optimal comfort and support of the user.

In addition when a traditional shoe is broken, damaged or no longer fits correctly it must be thrown away. However with a modular shoe, parts can be replaced therefore the invention is eco-friendly.

The channel may be arranged within the sole, between layers of the sole or be provided between the sole and another part of the modular shoe such as the heel.

Preferably the modular shoe includes a locking means to lock the connection portion with respect to the channel. In this way once the shoe upper is located in the desired location it can be locked in position to prevent movement during wear.

Preferably the channel is accessible from a side edge of the sole so as not to interfere with the wearer's foot. Ideally the channel passes all the way around the sole so that a shoe upper can be positioned at any location about the sole by gliding the connection portion of the shoe upper along the channel.

In some embodiments the channel may be provided in sections for example a right channel and a left channel.

The channel is formed from a strong, durable, lightweight material that is suitable for repeated use. Typically the channel may be formed from a lightweight metal. Ideally the channel has a smooth rounded outer face to engage with the connection portion to ensure it can run smoothly about the channel without being inhibited.

The channel may have an arcuate cross section. In some other embodiments the channel may have an angled cross section such as a square, trapeziod, X-shaped or triangular cross section.

Preferably the channel is coated with an external layer to provide a smooth finish along which the connection portions may slide.

Ideally the channel is embedded into the sole edge so that the opening is flush with an edge of the sole. Advantageously this enables to channel to be securely fitted to the sole.

In some embodiments the channel may form a layer of the sole in the form of a core wherein an outer edge of the layer includes the channel thereby providing integral strength to the sole and preventing dislodgment of the channel from the sole.

The channel ideally is narrowed at its opening so as to prevent the connection portion from disengaging from the cavity of the channel. The connection portion is dimensioned to fit and move along the cavity that is larger than the channel opening.

Preferably the channel includes at least one entrance for accepting the connection portion so that the connection portion can enter and be retained by the channel. Typically the entrance comprises a section of the channel wherein the opening is enlarged so as to provide an entrance that can accept the connection portion(s). For example the entrance may be circular for accepting a round, hemispherical or disc shaped connection portion. In this way connection portions can only be added and removed at an entrance thereby ensuring the shoe upper is securely fitted to the sole in use.

In another embodiment the entrance may be provided with a cover to close the entrance and prevent escape of the connection portions that may result in undesirable detachment of the shoe upper.

Preferably the entrance may be arranged at a rear region of the sole, for example above the heel. The entrance may be arranged at any point along the channel and in some embodiments there may be more than one entrance to the channel.

In some embodiments the body of the connection portion may comprise a ball bearing having an arm that connects to the shoe upper.

Typically the connection portion comprises a body suitable for being received by the channel and an arm dimensioned to extend through and from the opening of the channel wherein a first end of the arm is connected to the body and a second end of the arm is connected to the shoe upper.

In some embodiments the arm is rigid and may be shaped so as to lie adjacent the shoe in use. For example the arm may be slightly arched or stepped to as to accommodate the sole edge.

Preferably the arm is flexible so as to lie flush to the sole. The arm may also be elasticated so as to provide additional comfort during wear.

Typically the arm is elongate and planar so as to pass over the sole edge. In some embodiments the arm may be shaped or profiled so as to correspond to the shoe upper attached at the second arm. For example the arm may taper from a second end to a first end.

The arm may also form part of the aesthetic appearance and eye appeal of the modular shoe. For example it may provide additional detail to the shoe or be made a different shape, colour and/or material.

In some embodiments the arm may be pivotably attached to the body so as to permit movement of the arm relative to the body thereby providing additional comfort in use.

The locking mechanism enables the connection portion to be locked in a fixed position in the channel.

In some embodiments a securing member may be fitted into the channel to fix the body and/or arm in a particular position or orientation. The securing member may be decorated so as to be a decorative item on the shoe. For example the securing member(s) may be different colours, or may include diamantes cubes. Therefore the securing member may serve two purposes: to prevent movement of the connection portion in the channel and act as a decorative item.

In some embodiments the locking mechanism may comprise recesses arranged within the channel that are adapted to receive connection portions. In this way as the connection portion is aligned with the desired recess it is manipulated so as to engage with the desired recess thereby becoming locked in position.

Typically the body of the connection portion may be pulled or pushed into the recess so as to engage it in a fixed position.

In some embodiments the body may be adapted to be twisted or turned in order to engage the body with the recess.

In some embodiments the body may be magnetic so as to be received by and held by a magnetic region of the recess.

In another embodiment the opening may include grooves for receiving the arm section of the connection portion so as to locate the connection portion. For example, the channel may have a plurality of grooves arranged on an upper edge of the channel opening so that as the connection portion is positioned and the shoe upper is place over the wearer's foot, the arms are orientated upwards and become engaged with the grooves thereby locking the connection portion in a particular groove in the channel. Advantageously this may also permit the, or each arm, to be arranged flush against the sole.

In some embodiments the sole may have a corresponding groove so that the arm slots into the groove of the channel and sole and so that it is concealed within the sole in order to appear integrated with the sole.

In some embodiments the arm may be hinged so that the arm is straight whilst being located in the channel and is then bent at the hinge, so as to lock the connection portion in the channel. The hinge may permit the body to more readily fit into a recess or the arm to more readily fit into a groove.

In yet further embodiments movement of the arm hinge may be employed so as to cause a part of the body to extend or expand and so engage with inner faces of the channel thereby locking it in position. For example the body may include a projection that protrudes on at a bending of the hinge thereby creating friction with the channel that holds/locks the body in place.

In some preferred embodiments the connection portion and/or channel may be adapted to provide an audible sound, such as a click, when correctly engaged in order to advise the wearer that the connection portion is locked in place in the channel and therefore the upper shoe is secure and suitable to be donned.

The second end of the arm is connected to the shoe upper. In preferred embodiments the shoe upper is attached to the sole by at least one connection portion and typically more than one so as to define an area for receiving the wearer's foot. For example a shoe upper comprising a strap may have a connection portion at each end thereby having two points of connection to the sole.

Typically the shoe upper is shaped so as to pass over the foot in order to define an area in which the foot is located in use. Several shoe uppers may be provided to define this area depending upon the style of shoe that is configured. The shoe upper is provided in various styles in order to provide different types shoes. For example the shoe upper may comprise, but is not limited to, the following styles:

a sandal
a court shoe
a sling back shoe
a peep toe shoe
a clog
a boot
a 'Mary Jane'
a flip-flop The shoe upper may be constructed from one or more parts. For example the show upper may comprise or include a moulded or shaped upper or at least one strap.

The shoe upper comprises a plurality of parts, for example for a sandal having at least one strap or the show upper may comprise a single part for example for a court shoe upper.

It is appreciated that the number of parts does not necessarily reflect the number of potential connection portions. For example a court shoe upper may have multiple connection portions. This enables the modular shoe to provide extra support for some forms of shoe such as a high heel that may require increased support so as to support the wearer's foot.

The shoe uppers may be formed from a variety of materials including but not limited to: leather, synthetic plastics, rubber, suede, mesh, net, wire, string or beads.

Preferably the shoe uppers are sized so as to correspond to a range of shoe sizes. In this way the wearer can purchase the shoe upper of the desired size.

In some embodiments the shoe upper is adjustable or may include adjustable portions so as to allow adjustment, so that the shoe upper can be further fitted to the wearer's foot. For example the shoe upper may include or comprise a buckle so as to allow adjustment such as of a toe strap or ankle strap.

Advantageously by the shoe upper being adjustable this may allow a more accurate fit therefore reducing movement of the foot in the shoe, thus preventing rubbing.

Furthermore in some embodiments the shoe upper may include additional connectors for securement about the wearer's foot, for example ankle or foot straps or ties.

The modular shoe of the present invention enables a sole to connect to various shoe uppers so that appearance of the donned shoe can be changed readily by the wearer. Therefore the wearer is able to customise their shoes. Advantageously this means that fewer pairs of shoes may be required and instead parts of the modular shoe can be exchanged to provide a 'new' pair of shoes. Therefore the modular shoe reduces space required to keep shoes and the wearer is able to 'travel lighter' by not having to carry multiple pairs of traditional shoes for different events or styles.

Preferably the sole is substantially planar having an upper face for receiving the wearer's foot and a lower face for interfacing the ground. The wearer therefore has one pair of soles capable of accepting a variety of shoe uppers. Therefore one sole may be used to create various modular shoes.

In preferred embodiments the sole is dimensioned to receive a foot, providing a platform upon which the wearer's foot is supported upon the upper face when the modular shoe is donned.

In some embodiments the sole may be contoured to reflect shape of the foot, for example to follow/correspond arches of the foot.

The sole is dimensioned in a similar manner to that of a sole in a traditional shoe typically matching a wearer's footprint so as to receive a wearer's foot. However with the modular shoe the sole is not permanently attached to other parts of the shoe but instead is a part of used to form the modular shoe. Therefore if a wearer's foot shape changes, any part of the modular shoe can be amended to accommodate this. For example a larger sole may be provided and then the wearer can use existing parts, such as shoe uppers and decorative items, which can be applied to the new sole. In some embodiments the sole may have a shape that does not directly match the wearer's footprint. For example the sole may have a square toe region or a pointed toe region in order to alter shoe style and appearance.

Typically the sole is provided in a plurality of sizes to suit different wearers. For example the sole may be provided in shoe sizes and in width fittings or bespoke sizing.

It is appreciated that a sole may be made to suit specific, individual requirements of a wearer. For example the sole may be bespoke in order to reflect fit, style, support provided and intended use and this is beneficial where a wearer's feet are significantly different as it enables bespoke sizes of shoe to be provided for each foot.

Ideally the sole is formed from a resiliently deformable material so that it is able to flex when worn for optimal comfort but repeatedly returns to a preferred form in order to provide support to the wearer's foot. This allows the wearer to walk comfortably in the shoes as the sole flexes during times when it is weight bearing.

In preferred embodiments the sole has a strong semi-rigid core encased in an outer later for improved strength. Typically the core is defined by a metal insert. In some embodiments the core may provide the layer with which the channel is associated so as to provide a dual function.

Preferably the sole includes a metal insert surrounded in a synthetic plastic material. Ideally the metal insert is formed from titanium so as to provide strength, is durable and is able to flex so as to allow some movement as the wearer is walking. Other metals or metal alloys such as stainless steel or aluminium may be used.

In some embodiments other materials with similar properties may be used, for example the core may be formed from carbon fibre or Kevlar (Trade Mark)

Ideally the outer layer is formed from a flexible material for example a polymer or rubber so as to allow the metal insert to flex.

In some embodiments the sole may be formed from more than one layer. For example the sole may be laminated for improved strength and durability.

Alternatively or additionally the sole may have a soft upper layer for receiving the wearer's foot and a lower layer for interfacing the ground for improved grip.

The upper layer that receives the foot may be formed from a synthetic material or a natural material such as leather. In some embodiments the upper layer may include or be comprised of a breathable and/or cushioned material, such as a cellular material such as foam covered in suedette. In other embodiments the upper layer may be covered in a fabric or s synthetic plastic.

The lower layer that interfaces the ground may comprise an anti-slip material for example a resiliently deformable material such as rubber in order to provide grip.

In some embodiments only part of the lower layer of the sole is covered by the layer, for example so that only the area on the sole that directly connects with the ground includes the additional lower layer thereby reducing weight of the shoe and requirement for extra materials. For example when wearing high heels only a ball of the foot may come into contact with the ground, therefore only this portion needs to be covered by the lower layer.

In some embodiments part of the lower face may have a textured surface, for example raised and lowered portions to provide tread. Furthermore the lower face of the sole may be reinforced and/or coated in a resiliently deformable material, such as rubber, for improved strength, grip, durability and longevity.

The sole may be provided in a selection of colours and finishes. For example the sole may be provided in clear, white, black, silver, gold, metallic, glittered or mirrored. The sole may be formed from a clear material and the metal insert may be visible.

Preferably the sole may be adapted for creating a heeled modular shoe. Therefore the sole may be stepped, typically serpentine in shape, in order to match the shape of a foot in a heeled shoe.

A sole for use in a heeled shoe may be provided with an integrated heel or may include a heel receiving means for attaching a heel to its lower face.

Where a heel is attached to a sole ideally the heel is attached to the sole by means of a lock mechanism. In this way a heel can be securely locked to the sole when the modular shoe is to be worn.

For example the heel may be connected to the sole by means of a thread, one or more magnets, a clip, a sliding means, a hole and pin arrangement or a detent mechanism so as to engage with the sole.

In some embodiments the lower face of the sole includes at least one projection for receiving the heel. The heel includes a corresponding recess for receiving the projection. For example the heel may include a resiliently deformable inner construction for receiving a spike arranged on the lower face of the sole.

In some embodiments the core of the sole may be shaped to correspond to the projection wherein the core includes a projection that is encased/encapsulated by at least one outer later. Advantageously this provides additional strength to the heel. In a preferred embodiment the projection and recess may be threaded to that they can be screwed together or may comprise a twist lock.

In some other embodiments the lower face may include at least one rail into which the heel can be slid on to.

The sole may be provided with a variety of different heels so that the wearer can choose shoe a specific style or colour of heel.

Advantageously in some embodiments the heels may be interchangeable so that different heels may be applied to the same sole thereby allowing the shoe to be changed from one style to another. In such embodiments it may be envisaged that the modular heel is of a construction similar or the same as that of standard shoes with inclusion of a means for connecting the heel to the sole.

In some embodiments the lower face of the sole and upper face of the heel may have interlocking portions so as to permit engagement of these parts. For example the lower sole face and upper heel face may have corresponding interlocking male and female portions. For example the opposing faces may be toothed. In this way the channel is defined by the region between a lower face of the sole and an upper face of the heel.

In such embodiments a lower face of the sole may also include a plurality of grooves for receiving connection portions so that shoe upper(s) can be located on the sole or heel prior to the sole and heel being engaged together. Therefore joining of the heel and sole serves to lock the connection portions in position.

In another embodiment the connection portions may additionally be fitted to the sole and/or heel for example by being screwed into it, by way of a friction fit or a click fit into a face of the heel or sole prior to the heel and sole being engaged. In this way the connection portions and any connecting means are fully concealed during use, being encapsulated within the modular shoe.

In yet further embodiments the sole may be formed from at least two layers so as to permit the connection portions to be located and fixed between the two layers and thereby concealed. In this way the channel is defined between the layers of the sole.

In another embodiment the heel may include at least two layers so as to permit connection portions to be located and fixed between two layers and thereby concealed in use. In this way the channel is defined between the layers of the heel.

The sole and heel, layers of sole and layers of heel may all be adapted to be separated to accept and release connection portions which can then re-joined to the heel. The mechanisms to enable separation and re-joining may include but are not limited to clip fittings, a detent mechanism, interlocking portions and/or a magnetic means.

The modular shoe heel may comprise but is not limited to any of the following heels:

stiletto
wedge
court
cuban
kitten
platform

The heel may be available in a selection of heights as wells as different styles. This therefore allows a wearer to select their desired heel at the desired height for optimal comfort and style.

In some embodiments it may be possible to stack different heels on a single modular shoe, so that for example a kitten heel is attached to the sole to provide a kitten heeled modular shoe. A wedge heel may then be 'stacked' over the kitten heel so as to conceal the kitten heel and now giving the appearance of wedge heel. In the same way that for example a stiletto heel may be over stacked by a court heel. In this way shoe style can be readily changed from one type to another.

Parts of the modular shoe may be provided in a selection of colours, materials and finishes so as to alter appearance of the modular shoe. For example heel, sole or shoe upper colour may be co-ordinated to an outfit, or may be embellished with jewels for example the heel may be encrusted in crystals.

In some embodiments the heel may include attachment means for securing accessories directly to the heel.

Advantageously the channel may also accept decorative items wherein the decorative item includes a connection portion.

In some embodiments the modular shoe may include attachment means for securing decorative items to the modular shoe.

In some embodiments the attachment means may be used to the shoe upper to the sole. For example the shoe upper or sole may have corresponding members for connecting with the attachment means.

The decorative items/accessories may be attached to the modular shoe in order to further alter/enhance shoe appearance.

The decorative items/accessories are from the group comprising but not limited to: bows, ribbons, clasps, images, logos, corsages, jewels, beads, toys, charms and trinkets.

The decorative items are used to embellish the shoes. For example a shoe could be embellished to coordinate with a particular outfit.

The attachment means may comprise a continuous loop with no breaks so as to be strong and not liable to breakage. In this way the corresponding decorative items are securely fixed to the loop. Preferably the loop is flexible so as to capable of arrangement over a corresponding decorative item.

In some embodiments a plurality of loops are provided on the sole, heel and/or shoe upper.

In some embodiments parts of the modular shoe such as the sole may include a cutaway or indent in which the attachment means can be stowed when not in use. It may be envisaged that the attachment means such as the loop or member may be tucked into the cutaway or indent so as to be concealed when not in use. In this way the sole can be adapted to have some attachment means that are in use for a particular shoe upper and some that are stowed when not required for a particular shoe upper.

In some embodiments the loop may include a degree of elasticity in order to allow the loop to be stretched over a decorative item that is greater in size than the loop when not stretched. In this way the loop is fixed in place when located over the decorative item. Typically the loop may be formed from a heavy-duty elastic material with minimal stretch so as to prevent excessive movement of the decorative item when donned.

In some embodiments the attachment means may comprise an interference fitting such as a press stud having a female part and a male part that mate in order to engage and thereby connect the decorative items.

In some other embodiments the attachment means may comprise interlocking parts, a male part and a female part that mate in order to provide a connection.

In yet further embodiments the attachment means may include or comprise at least one screw for connecting parts decorative items to the modular shoe.

In some embodiments the attachment means may be hinged so as to allow the attachment means to pivot from a fixed point so as to enable the decorative items to be arranged at different angles. Furthermore if the attachment means are use to fix a shoe upper to the sole a hinged attachment means will allow movement whilst the modular shoe is worn allowing the attachment means to move relative to the wearer's feet.

It is appreciated that alternative fixtures may be used to connect or aid in connection of parts of the modular shoe together such as rivets, push fittings such as press studs, hook and loop means, hook and eyes, buttons or magnetic means.

Preferably the attachment means are arranged so as not to interfere and in particular not to rub the feet when the shoe is donned.

As the shoe is comprised of modular parts the sole, shoe upper and/or heel can be changed to provide a different appearance.

In some alternative embodiments the sole may be provided with at least one fixed shoe upper, for example a trio of straps including two toe straps and a heel strap that are integrated with the sole. The sole may then include at least one attachment means for securing accessories. In this way appearance of the modular shoe can be changed by addition of accessories whilst the straps remain permanently fixed to the sole.

The modular parts may be made available from a supplier to encourage purchasers to select parts in order to create a customized shoe. Customers may be offered this choice whilst they have their feet sized to allow them to purchase the appropriate sized sole/shoe upper/heel.

Advantageously a wearer is able to adjust the shoe upper at any time by moving the location of the connection portion in the channel, for example unlocking it from its fixed positon and moving it to a new position before locking it in place again. Therefore, if for example a wearer's feet swell, the shoe upper could immediately be adjusted to improve comfort and prevent rubbing. Accessories are preferably not sized and may be suitable for any shoe.

In some embodiments the modular shoe may be provided with a heel protector that is fitted when the desired configuration is selected.

Ideally the heel protector includes a stopper that interfaces the ground in use. The heel stopper is connected to a heat activated sleeve dimensioned to receive a heel. The sleeve is positioned about the heel and on application of heat becomes adhered to the heel.

For example the stopper may be connected to a high-grade heat sensitive plastic such as cellophane that is heated with a hairdryer causing it to shrink wrap about the heel. Advantageously a heat-activated sleeve may be integrated with the stopper so that it can be fitted to the heel like a glove and then heated so as to be fixed in position. For example the stopper may be adhered to the heat activate sleeve.

Typically the stopper is a heel section similar to those traditionally used to repair a shoe heel. The stopper may be coloured to match the modular shoe.

An inner face of the stopper may have a layer of adhesive so as to enable the stopper to adhere to the underside of the heel thereby fixing the stopper to the heel and prevent movement during use. Typically application of pressure, such as wearing the shoe, enables the heel to adhere to the stopper.

Advantageously the heat activate sleeve may be transparent or coloured to match the modular shoe so as to not detract from appearance of the shoe. The heel protector serves to prevent damage to the heel during wear.

Preferably the heat activate sleeve can be removed from the heel without causing damage so as to enable a new heel protector to be added if damaged or tarnished.

Advantageously the wearer of the modular shoe can create various types of shoe to include flat shoes and heeled shoes as well as a plurality of shoe types, such as court shoe or sandal.

Furthermore, in some embodiments, the wearer is able to convert a flat shoe to a heeled shoe and vice-versa by attachment of different heels to a sole. For example a wearer may have a modular shoe in the form of a flat sandal for day time use wherein a heel is added to the sole to convert the modular shoe to a heeled shoe that is suitable for wearing in the evening.

This method of creation of a modular shoe gives the wearer the option to customise shoes, for example to coordinate with clothing or for particular events or locations. For example a stiletto heel may be exchanged for a wedge heel if the venue is on a grassy surface.

In preferred embodiments a wearer may purchase a kit comprising a pair of soles sized to the wearer's feet and a selection of heels, upper shoes and accessories. Preferably the kit may be provided in a box, case or container so that all parts of the modular shoe can be kept together.

It may be envisaged that the modular shoe and/or the accessories may be branded for example to include a logo of a designer, or to represent a nationality, team or product. A shop may be dedicated to selling the modular shoes wherein a large variety of modular parts are available so that a wearer can select a range of modular parts that can be configured in many different ways so as to provide multiple different shoes.

Preferred embodiments of the invention will now be described, by way of examples only, and with reference to the Figures in which:

BRIEF DESCRIPTION OF FIGURES

FIGS. 5A to 5F show examples of various shoe uppers;

DETAILED DESCRIPTION OF FIGURES

The Figures show a variety of modular shoe configurations and modular parts that can be combined to form customised modular shoes.

Figure 1A:
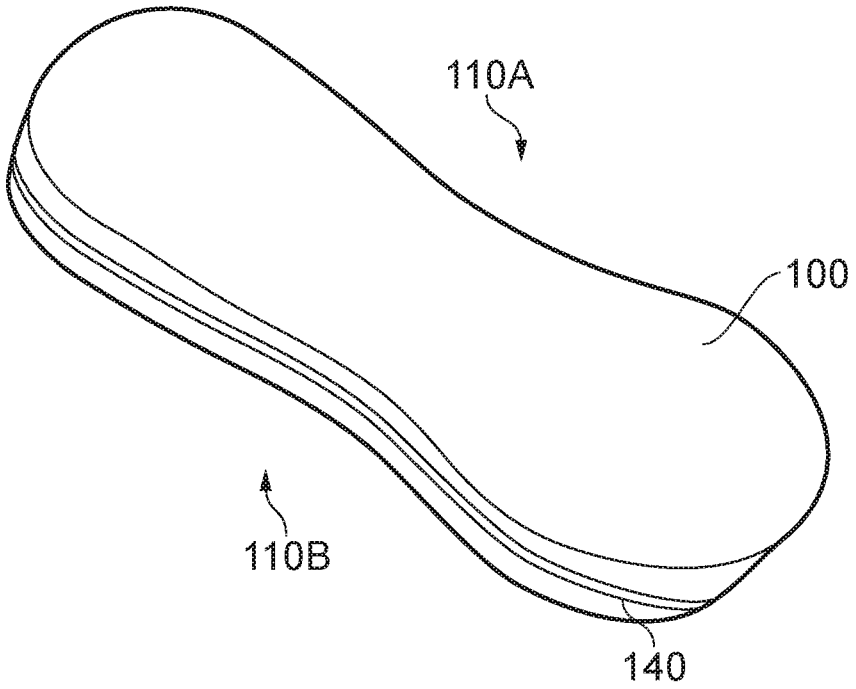
FIG. 1A shows an isometric view of a sole.
Figure 1B:
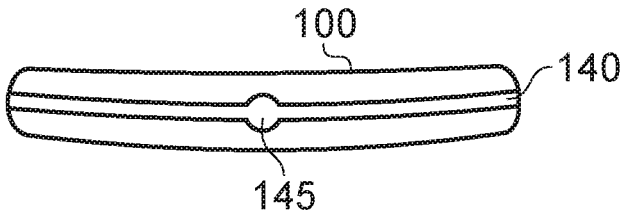
FIG. 1B shows a rear end view of a sole.

FIGS. 1A and 1B show a sole 100 having an upper face 110A for receiving the foot and a lower face 110B for receiving the ground and/or a heel. The sole 100 is substantially planar having a smooth upper and lower face. The sole 100 includes a channel 140 for receiving a connection portion (not shown) along which the connection portion that attached the shoe upper to the sole can be slid to the desired position. The channel 140 passes around the perimeter edge of the sole.

FIG. 1B shows the channel 140 having an entrance 145 through which a body (not shown) of the connection portion can be inserted in order to enter the channel. The channel is tapered towards to opening that is exposed on the sole edge so as to retain the connection portion.

The entrance 145 is round and larger than the opening of the channel 140 so as to be able to accept the body of the connection portion and then retain it within the channel once slid along away from the entrance.

Figure 2A:
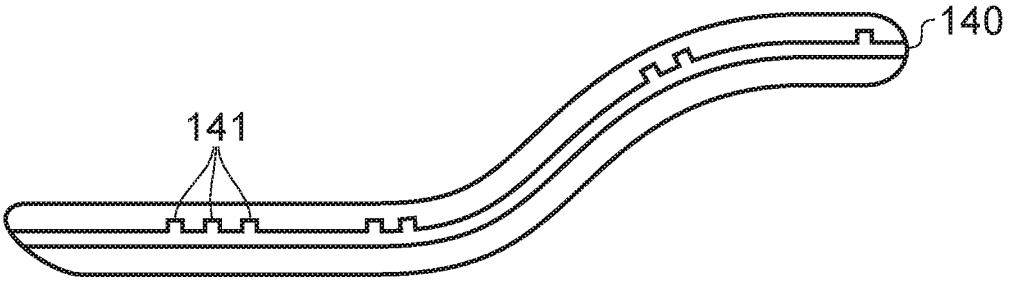
FIG. 2A shows a side view of a sole having a channel with grooves.

FIG. 2A shows a side view of the sole 100. This embodiment of the sole 100 has a channel 140 wherein the channel 140 includes a plurality of grooves 141 into which an arm (not shown) of the connection portion (not shown) can be accepted into when the connection portion is arranged in the desired location so as to lock the connection portion into position.

The grooves 141 are arranged on an upper edge of the channel opening 140A so that the arm is locked upwards, thereby aligning the shoe upper (not shown) in such a way that it is arranged over the user's foot.

The groove 141 typically corresponds to shape and in particular cross-section of the arm.

Figure 2B:
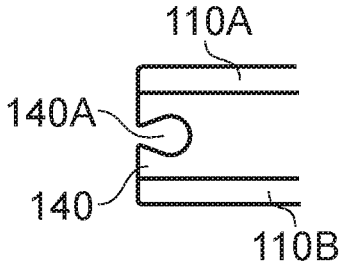
FIGS. 2B, 2C and 2D shows a selection of different channel cross sections.
Figure 2C:
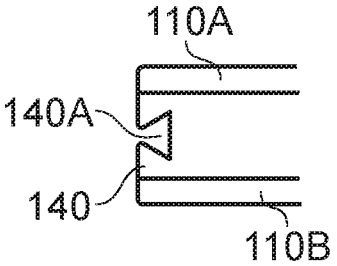
Figure 2D:
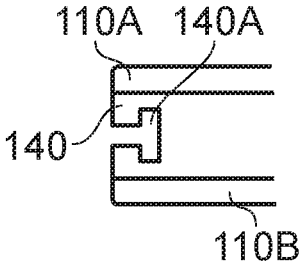
Figure 2E:
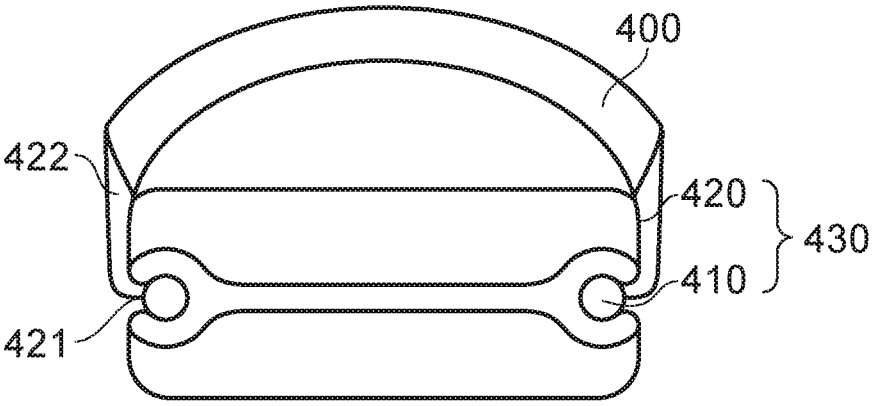
FIG. 2E shows a cross section of a sole with a shoe upper connected.

FIG. 2E shows a cross section of the sole 100 having a shoe upper 400 fitted to the shoe 100. The shoe upper 400 comprises a strap suitable for passing over the toe region of a user's foot. Each end of the shoe upper 400 has a connection portion 430 for connection the shoe upper 400 to the sole 100.

The connection portion 430 comprises two parts, a body 410 for being received by the channel 140 and an arm 420 for connecting the body 410 at a first end 421 and for connecting the shoe upper 400 and a second end 422 of the arm.

The body 410 is a round ball that sits in an arcuate channel 140 in use. Therefore the body can easily pass along the channel 140.

The arm 420 is L-shaped so as to extend from the channel 140 and adjacent the sole edge towards an upper face of the sole 110A. The length of the arm 420 corresponds to depth of the sole from the channel 140 to the upper face.

The channel 140 is shown in FIG. 2E is integrated with core 130 of the sole 100. Therefore providing a dual function of strength for the sole 100 and a connection means for the shoe upper 400. Additionally as the channel is integrated with the core 130 it is fully embedded within the sole 100, this prevents movement ensuring use and any risk of the channel 140 becoming detached.

FIGS. 2B, 2C and 2D show different embodiments of the channel 140 wherein the channel cavity 140A has different cross sectional shapes.

In FIG. 2B the cavity 140A is round for accepting a substantially arcuate body 410. FIG. 2C shows cavity 140A in the form of a trapezoid cross section for accepting a substantially trapezoid or triangular body. In FIG. 2D the cavity is T-shaped, typically for accepting a square, rectangular or disc shaped body with an elongate arm 420 that passes through the tapered opening of the channel 140.

Figure 3:
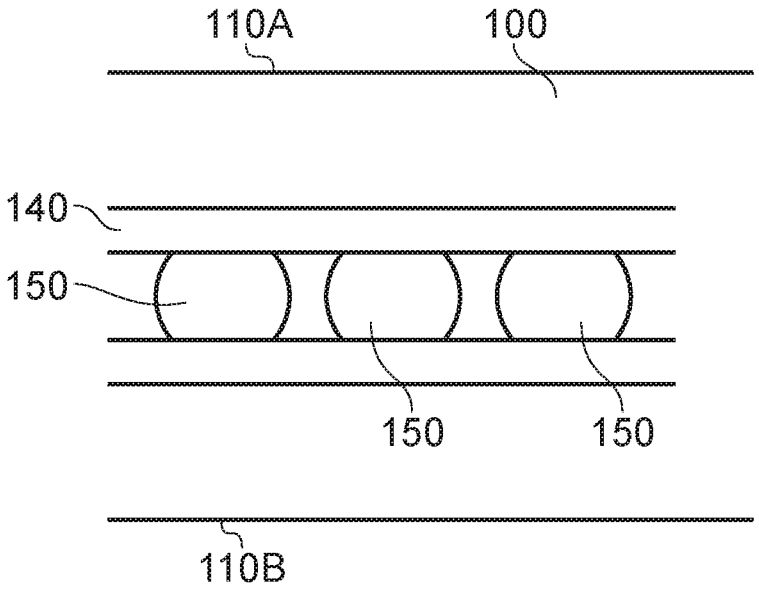
FIG. 3 shows a close up view of the channel having recesses for receiving a connection portion.

FIG. 3 shows a close up section of the channel 140 arranged in the sole 100. The channel has a plurality of recesses 150 into which the body 410 of the connection portion 430 can be engaged and thereby locked in position. Typically the body 410 is push fitted into the chosen recess.

Figure 4A:
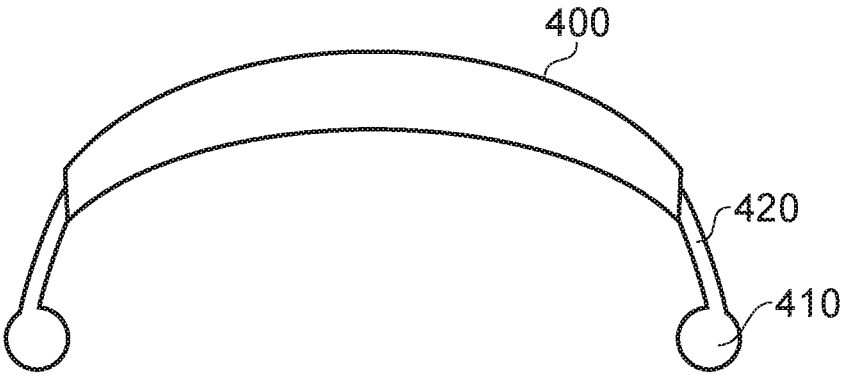
FIG. 4A show one embodiment of a shoe upper.
Figure 4B:
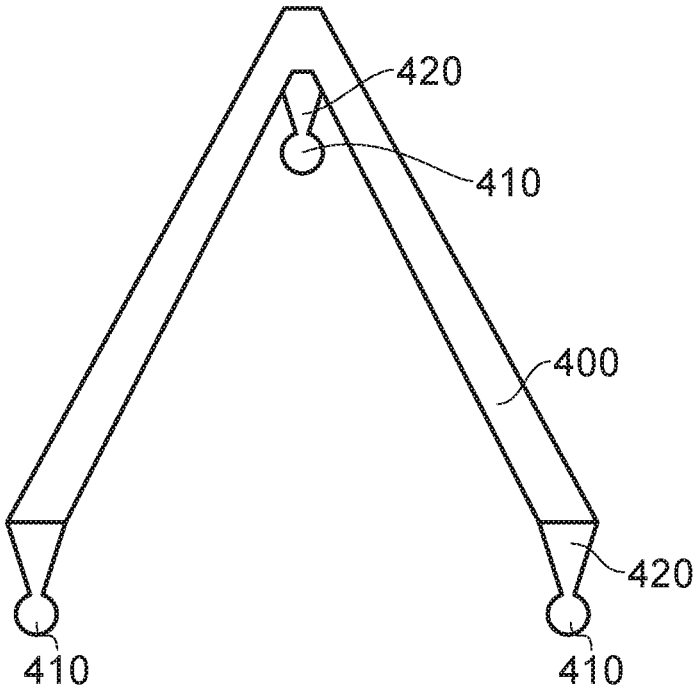
FIG. 4B shows a second embodiment of a shoe upper.

FIGS. 4A and 4B show two embodiments of shoe uppers 400. FIG. 4A is a shoe upper as shown in FIG. 2E. FIG. 4B is a shoe upper for configuring a flip-flop modular shoe. The shoe upper 400 having three connection portions 430 each comprising a body 410 and an arm 420 thereby enabling the shoe upper 400 to be connected to the sole 100 by means of the channel 140 at two locations and wherein the sole 100 has an aperture (not shown) for receiving the connection portion that is located between the user's toes when donned.

FIGS. 5A-5F show a plurality of different shoe uppers 400 that may be attached to the sole 100. Each shoe upper is attached to the sole by connection portions 430 (the connection portion shown does not show the body and arm.

FIG. 5A connects to the channel in six locations. FIG. 5B shows a mesh shoe upper 400 with 6 connection portions 430. FIG. 5C shows four straps linked to a flower having and a single toe strap thereby providing 6 connection portions.

FIG. 5D shows three straps for location in use over a wearer's instep wherein each strap end including connection portions at each end to provide six connection portions 430. FIG. 5E shows a toe strap to create a mule type sandal having a connection portion 430 at each corner.

FIG. 5F shows a sandal type shoe upper 400 have a heart combined with plurality of straps. The sandal shoe upper includes six connection portions.

Figure 6A:
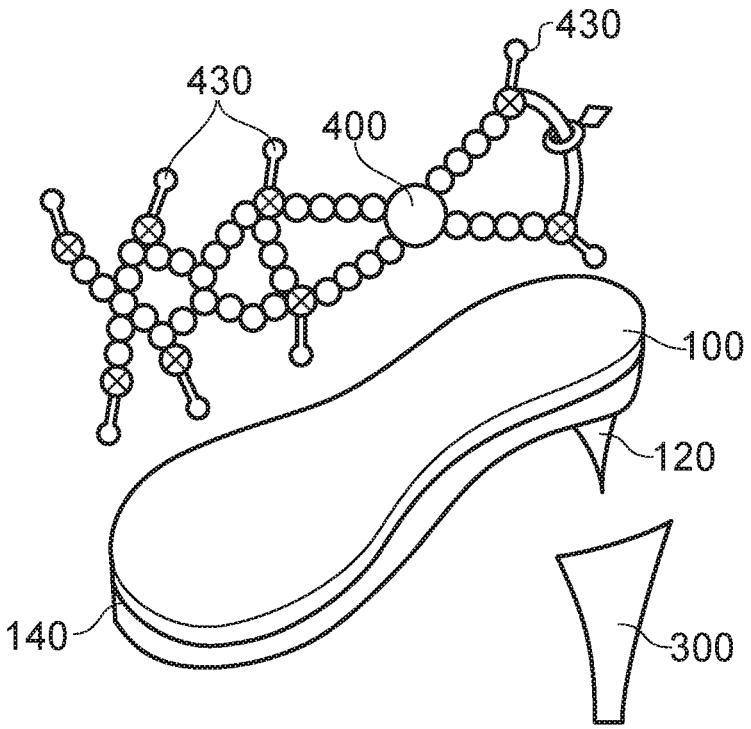
FIG. 6A shows an exploded view of a modular shoe.

FIG. 6A shows an exploded view of a modular shoe having a sole 100, shoe upper 400 and a heel 300. The sole includes a loop 200A for receiving a decorative item (not shown).

The shoe upper 400 includes eight connection portions 430 for connecting the shoe upper 400 to the sole 100. The sole includes a threaded projection 120 for receiving the threaded heel.

Figure 6B:
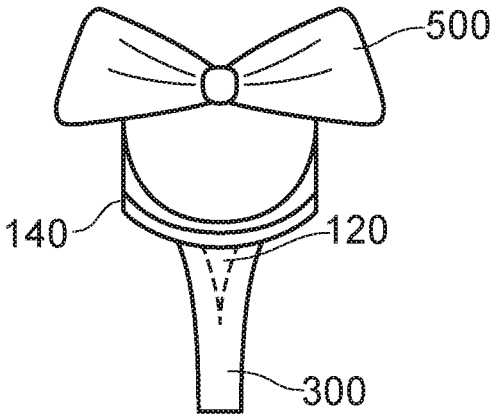
FIG. 6B shows a review view of a modular shoe.

FIG. 6B shows a rear view of a modular shoe with a bow accessory attached to the heel region by attachment means (not shown).

Figure 6C:
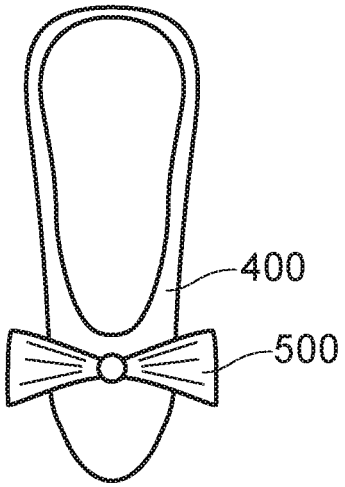
FIG. 6C shows a top view of a modular shoe.

FIG. 6C shows a top view of a modular shoe having a shoe upper with a bow fitted at the toe region by attachment means (not shown).

FIGS. 7A-7F show a selection of detachable heels 300 that can be interchanged in order to customise the modular shoe.

Figures 7A, 7B:
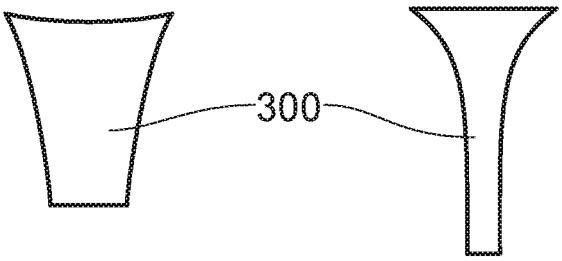
FIGS. 7A to 7G show a selection of different heel types.
Figures 7C, 7D:
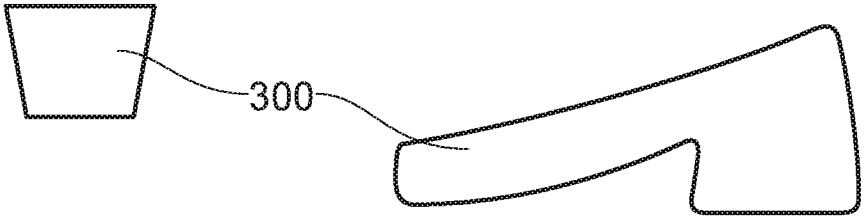

FIGS. 7A-7C show court heels 300 of different heights (3A and 3C). FIG. 3B shows a stiletto heel.

FIG. 7D shows a wedge heel 300 including a platform that extends along shoe length so as to elevate both the toe and heel region.

Figure 7E:
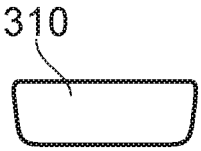
Figure 7F:
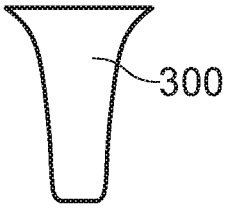

FIG. 7E shows a platform 310 to be worn in conjunction with a heel 300 such as that shown in FIG. 3F.

Figure 7G:
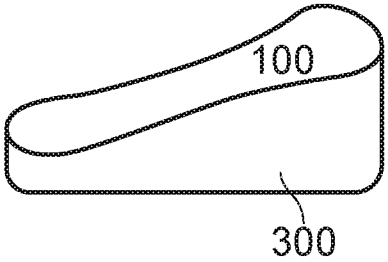

FIG. 7G shows a wedge heel 300 with a sole 100 arranged atop of the heel 300. The sole 100 is integrated with the wedge heel 300 so as to be a single part. In this way the wedge heel 300 and sole 100 may be manufactured as one part, for example being formed from a mould.

FIGS. 8A to 8F shows a selection of decorative items/accessories 500 that can be attached to any part of the shoe by attachment means 200 in order to decorate/embellish the shoe.

Figure 8A:
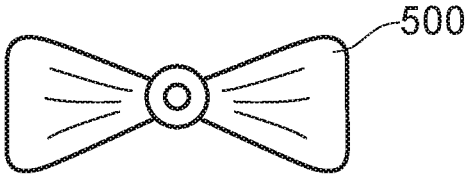
FIGS. 8A to 8F show a selection of decorative items.
Figure 8B:
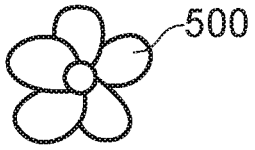
Figure 8C:
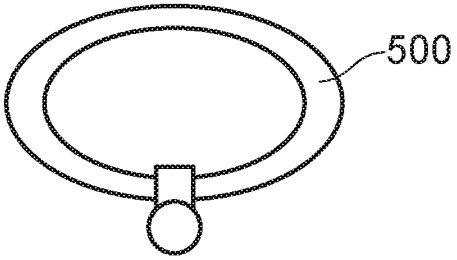
Figure 8D:
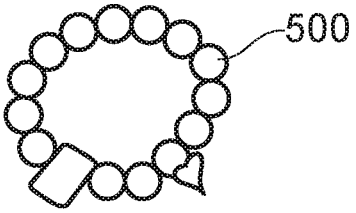
Figure 8E:
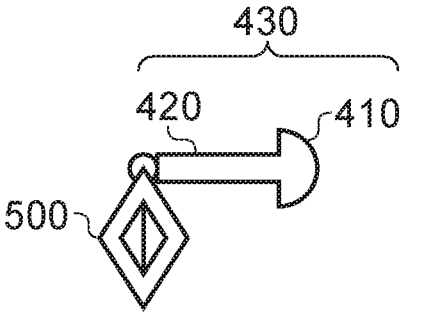
Figure 8E:
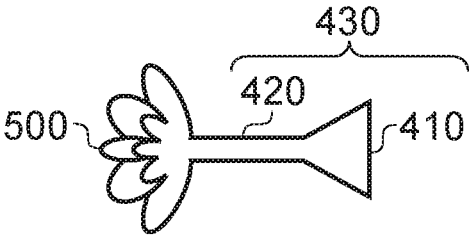
Figure 8E:
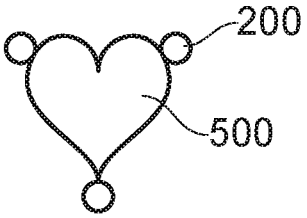
Figure 8F:
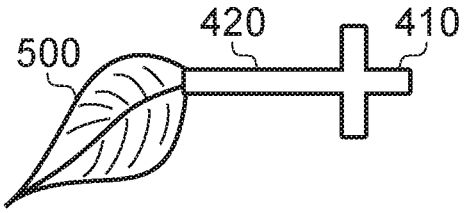

FIG. 8F shows three embodiments of decorative items with a connector portion 430 having body 410, and arm 420 and a decorative item 500. This provides the mean for attaching the decorative item 500 to the channel and or an attachment means. Three different types of body 410 are shown to include a hemispherical body, a triangular body and an X-shaped body. It is appreciated that the channel could be adapted to receive the body.

Figure 9:
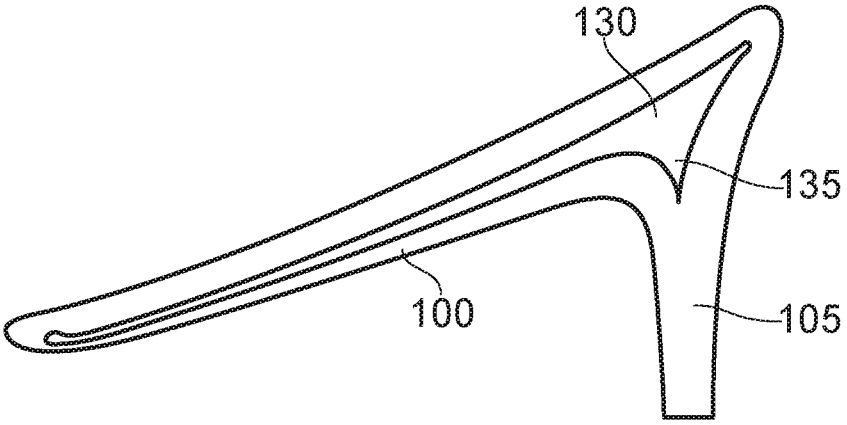
FIG. 9 shows a side view of a sole with an integrated heel.

FIG. 9 shows a cut through view of sole wherein the sole includes a metal core 130 to provide additional strength and durability to the modular shoe. The core 130 is a titanium plate embedded in a synthetic plastic sole 100. The sole is moulded to include a projection 105 that corresponds to the heel. The metal core 130 also has a projection 135 corresponding to the heel region. The metal core 130 is encapsulated by the sole 100 so that the metal is concealed. New heels may be slid on over projection 105,135 so as to alter appearance of the shoe.

Figure 10A:
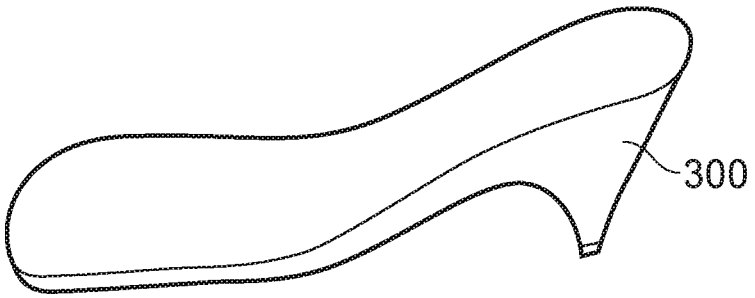
FIGS. 10A to 10C show variations of a stackable heel.
Figure 10B:
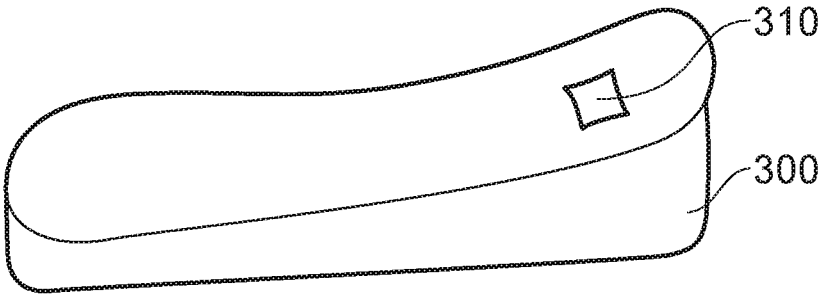
Figure 10C:
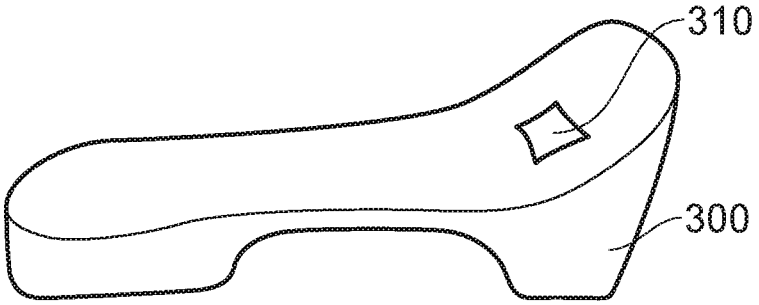

FIG. 10A shows a sole 100 with a kitten heel 300. FIGS. 10B and 10C show two alternative heel types that each include an aperture 310 arranged on an upper surface of the heel 300 for receiving the kitten heel of 10A so that the heels can be stacked. The stackable heels are connected by magnetic means.

Figure 11A:
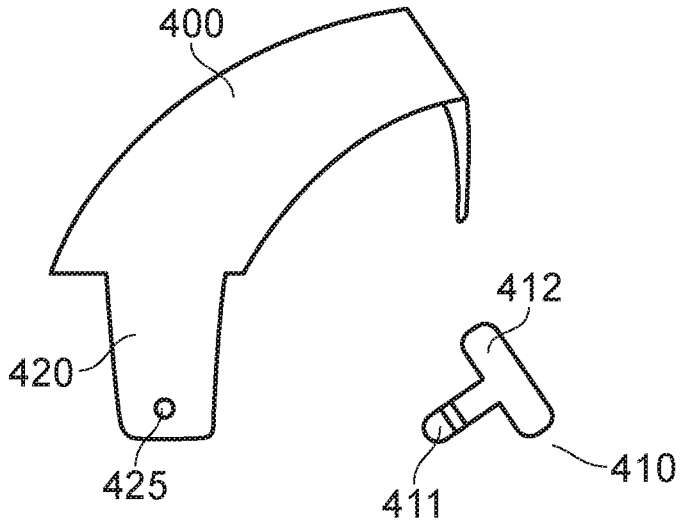
FIGS. 11A and 11B shows a second embodiment of a connection portion.
Figure 11B:
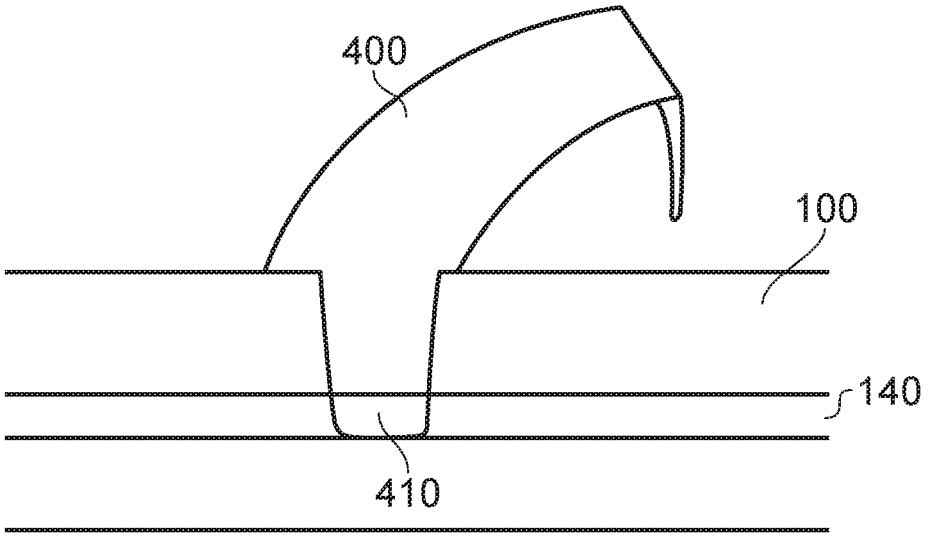

FIG. 11 shows a second embodiment of a connection portion wherein the arm 420 includes a hole 425 for receiving a part of the body 410. The body 410 is a T-shaped section with a head 412 and a neck 411 that is received by through the hole 425 and inserted into a corresponding void in the channel such that the body serves a pin that is clip fitted for example by a detent mechanism into the channel thereby securing the shoe upper to the sole. The head 412 is adapted to fit flush into the channel.

Figure 12:
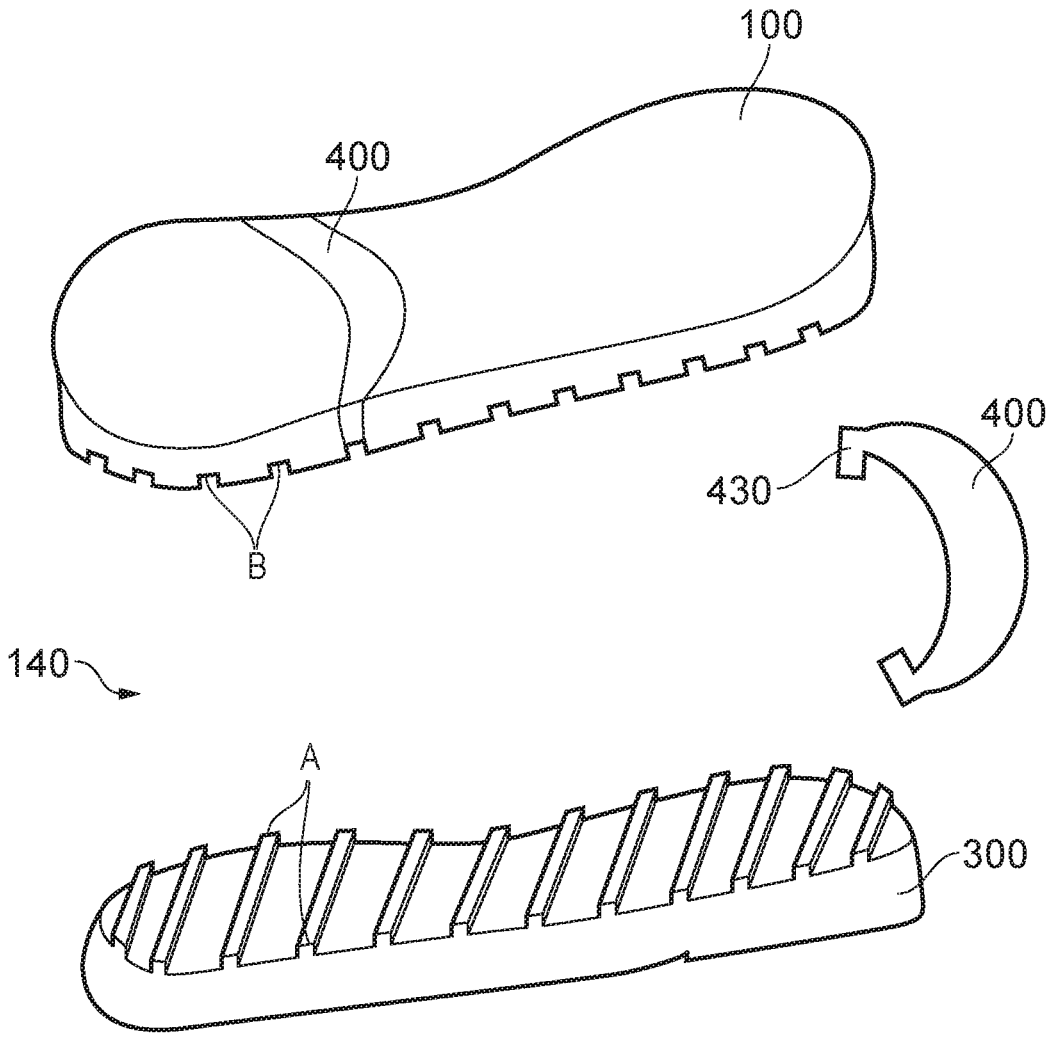
FIG. 12 shows a second embodiment of a channel and corresponding shoe upper and connection portion.

FIG. 12 shows an alternative embodiment of the channel 140 wherein the channel 140 is defined by a region between a lower face of the sole 100 and an upper face of the heel 300 so that together they provide a channel 140. The lower face of the sole and upper face of the heel have corresponding male A and female B portions that interlock so as to engage the parts together.

The shoe upper has corresponding connection portions that also fit within the female portions B of the sole prior to acceptance of male portion A of the heel. The female portion B is sized to be larger than male portion B to allow for fitting of the connection portion whilst still permitting the sole and heel to be in contact with each other across adjacent faces when engaged.

Figure 13B:
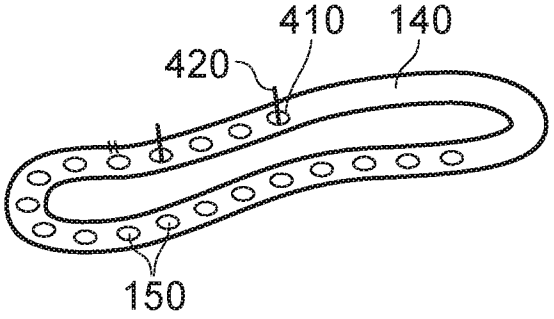
FIG. 13B shows a top view of a channel that is concealed between layers of the shoe.
Figure 13A:
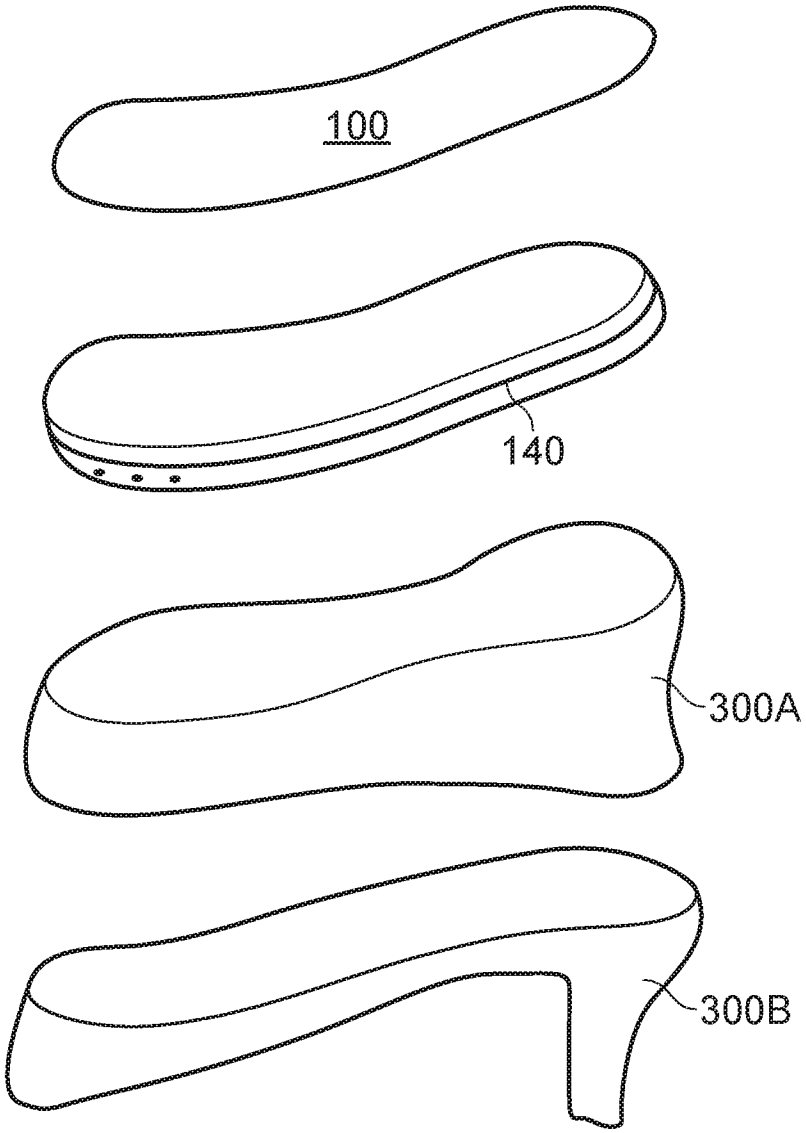
FIG. 13A shows a second embodiment of a stackable heel with an exploded view of the sole and channel.

FIG. 13A shows a second embodiment of a stackable heel wherein a wedge heel 300A can be accepted on to a court shoe heel 300B. An upper surface of the wedge heel 300A receives the channel that is sandwiched between the sole 100.

In this embodiment the channel 140 is concealed in use wherein the channel 140 is arranged between two layers 140A and 140B. To fit the connection portions, the two layers 140A and 140B are separated and the connecting portions (not shown in FIG. 13A) are located between the layers of the channel 140A, 140B and the layers then joined together thereby concealing the channel and holding the connection portions in position. In some embodiments the inner faces of the layers 140A and 140B are adapted to receive connection portions. In an alternative embodiment, additional connection means may be used to fix the connection portion in position, such as screw fixings.

FIG. 13B shows an alternative embodiment of the channel that may be arranged between the sole 100 and heel 300. The channel 140 has a plurality of arcuate recesses 150 suitable for receiving the body 410 of a connection portion 400.

Figure 14A:
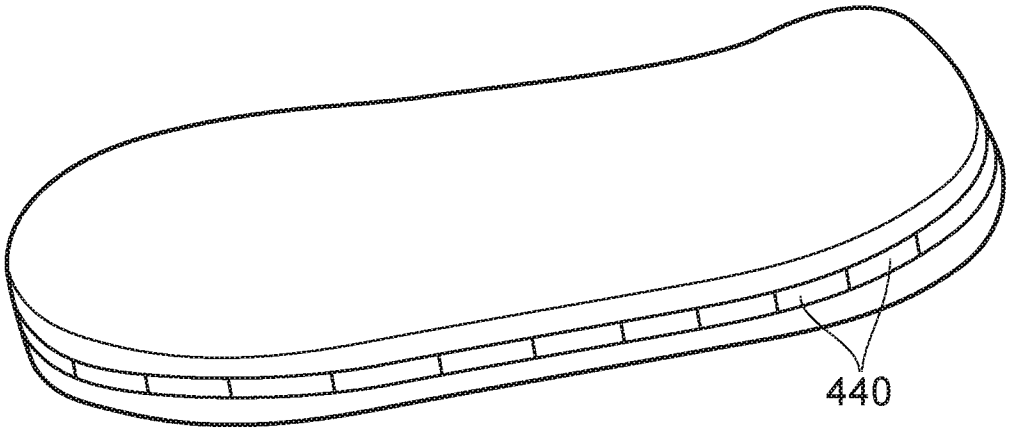
FIG. 14A shows a sole with a channel including securing members.
Figure 14B:
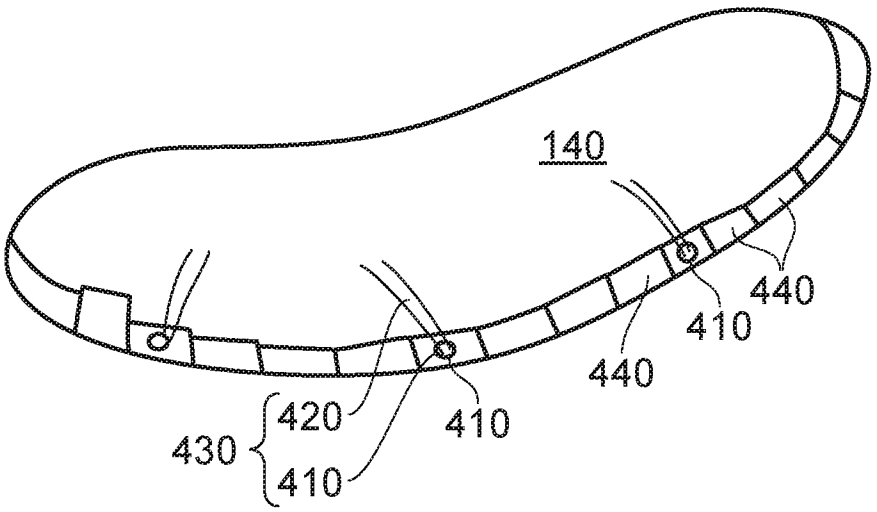
FIG. 14B shows a channel with connection portions fixed between two securing members.

FIGS. 14A and 14B show a channel having securing members 440. The securing members 440 serve to prevent movement of connection portions arranged in the channel 140 thereby providing a locking means. Typically the securing members 440 are arranged either side of a connection portion.

The securing portions are dimension to fit in the channel 140 and are formed from a resiliently deformable material such as rubber. They are dimensioned to form a tight fit in the channel 140 so as to remain in place and to prevent movement of the connection portions 430 along the channel 140.

Figure 15B:
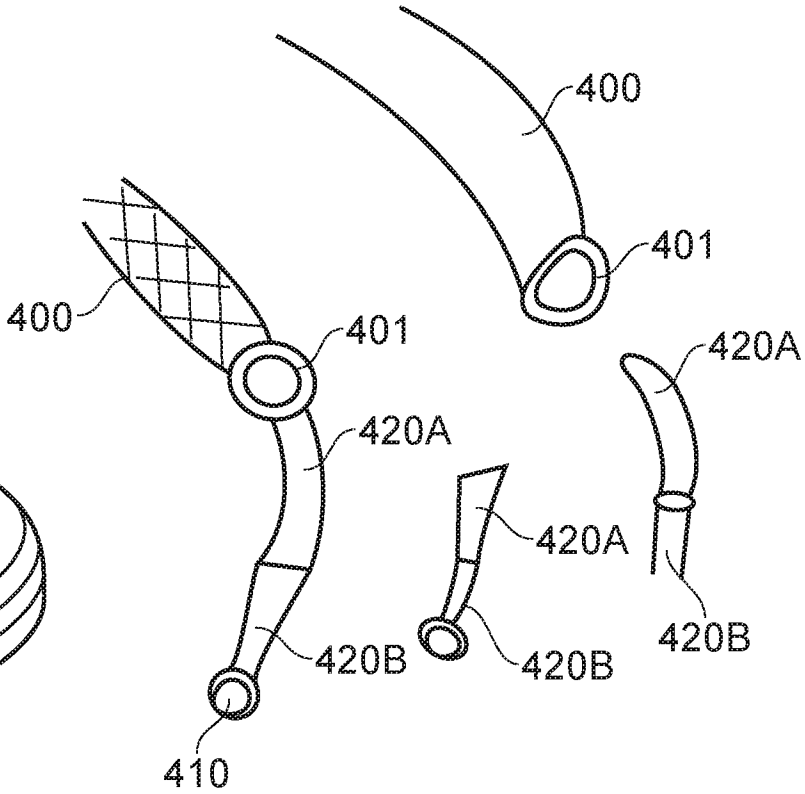
FIG. 15B shows the clip mechanism shown in FIG. 15A.
Figure 15A:
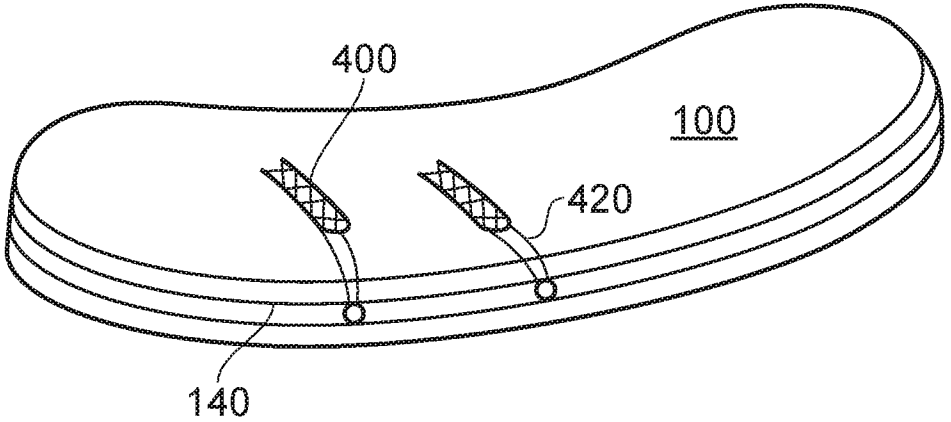
FIG. 15A shows a sole with two shoe uppers connected by a clip mechanism.

FIGS. 15A and 15B show a different embodiment of an arm wherein the arm is in the form of a folding clasp, having two parts hinged together so as to permit a first part of the arm 420A to pass through a ring on a shoe upper 400 and then fold at the hinge, so as to bring the first part of the arm parallel to the second part of the arm. The first and second parts of the arm 420A, 420B include a clasp so as to enable the first and second parts of the arm 420A, 420B to connect and therefore provide a connection between the ring of the shoe upper and the channel 140.

In some embodiments the two parts of the arm 420A and 420B may join by means other than a clasp such as a clip, buckle, detent mechanism or magnetic means.

The invention has been described by way of examples only and it will be appreciated that variation may be made to the above-mentioned embodiments without departing from the scope of invention as defined by the claims.

The invention claimed is:

1. A modular shoe adapted to be configured into at least two different forms comprises:

a two-layered sole comprising at least an upper sole and a lower sole, the two-layered sole receiving at least one shoe upper for arrangement over a user's foot, both the upper sole and the lower sole together forming a continuous channel around its outer perimeter/surface formed where the upper sole mates with the lower sole for receiving and engaging with the at least one shoe upper, an upper inner portion of the continuous channel being formed in the upper sole and a lower inner portion of the continuous channel being formed in the lower sole;

wherein each of the at least one shoe upper has at least one connection portion that is adapted to be received in the continuous channel so as to permit adjustable gliding of the at least one shoe upper with respect to the two-layered sole to a user desired configuration, by insertion of the at least one connection portion into the continuous channel;

wherein the continuous channel includes an entrance for accepting the at least one connection portion that is received by and retained in the continuous channel; and wherein the continuous channel includes a plurality of arcuate recesses extending outwardly from a periphery of at least one of the upper inner portion of the continuous channel and the lower inner portion of the continuous channel, the at least one connection portion engaging at least one of the plurality of arcuate recesses to lock the at least one connection portion at a fixed, non-gliding position selected by the user along the continuous channel away from the entrance so as to alter fit and/or appearance of the modular shoe.

2. The modular shoe according to claim 1 wherein the continuous channel is provided on a side edge of the two-layered sole so as not to interfere with a wearer's foot.

3. The modular shoe according to claim 1 wherein a lower face of the lower sole includes or is adapted to receive a heel.

4. The modular shoe according to claim 1 wherein at least part of a lower face of the lower sole that is adapted to contact ground has a grip surface.

5. The modular shoe according to claim 1 wherein the at least one shoe upper is adjustable so as to fit to a wearer's foot size.

6. The modular shoe according to claim 1 wherein the modular shoe has at least one connector with which a decorative item is attached to the modular shoe.

7. The modular shoe according to claim 6 wherein the decorative item is from a group consisting of:

bows,
ribbons,
clasps,
images,
logos,
toys, and
jewels.

8. The modular shoe according to claim 1 wherein the two-layered sole is flexible and substantially planar.

9. The modular shoe according to claim 1 wherein the at least one connection portion comprises:

a body for press fitted engagement in the at least one of the plurality of arcuate recesses in the continuous channel, and an arm for connecting the body to the at least one shoe upper.

10. The modular shoe according to claim 9 wherein the arm is flexible.

11. The modular shoe according to claim 3 wherein the heel is stackable.

12. The modular shoe according to claim 1 wherein the continuous channel is sandwiched between the upper sole and the lower sole.

13. The modular shoe according to claim 3 wherein the heel includes a heel protector.

14. The modular shoe according to claim 1 further comprising a core defined by a metal insert between the upper sole and the lower sole.

15. The modular shoe according to claim 1 wherein the upper sole separably mates with the lower sole.

16. The modular shoe according to claim 15 wherein the upper sole interlocks with the lower sole.

* * * * *